United States Patent [19]

Turpin

[11] 3,962,476

[45] June 8, 1976

[54] DOUGH PACKAGE CONTAINING TRIPLE SEALED ICING CUP AND METHOD OF PRODUCING THE SAME

[75] Inventor: Charles H. Turpin, Minneapolis, Minn.

[73] Assignee: The Pillsbury Company, Minneapolis, Minn.

[22] Filed: Aug. 26, 1974

[21] Appl. No.: 500,423

Related U.S. Application Data

[62] Division of Ser. No. 345,927, March 29, 1974, Pat. No. 3,851,757.

[52] U.S. Cl. ..... 426/398; 426/120; 426/128; 53/36

[51] Int. Cl.[2] ..... B65B 25/00

[58] Field of Search ..... 426/120, 128, 398; 53/27, 36; 220/17, 20, 22; 229/1.5, 21, 93, 51 BP; 206/217

[56] References Cited

UNITED STATES PATENTS

| | | | |
|---|---|---|---|
| 1,584,903 | 5/1926 | Supplee | 426/398 X |
| 2,076,132 | 4/1937 | Rose | 426/120 X |
| 2,604,976 | 7/1952 | Sarg | 426/120 |
| 2,949,369 | 8/1960 | Zoeller | 426/120 |
| 3,182,890 | 5/1965 | Elam | 426/120 |
| 3,371,460 | 3/1968 | Rait | 53/36 X |

*Primary Examiner*—Robert Halper
*Attorney, Agent, or Firm*—James V. Harmon; Michael D. Ellwein

[57] ABSTRACT

A process for forming a two compartmented fiber dough can comprising forcing a thermoplastic cup into the lower part of a container, inserting a duct close to the cup and filling the same with icing, forcing a divider plate into engagement with the cup and the inside wall of the can so as to form a triple seal, introducing a dough product on the opposite side of the divider and sealing the open end of the container with a top closure, and allowing the dough to proof.

1 Claim, 11 Drawing Figures

10
14
16

12
14
10
28
26
16
24
42
44
40

DOUGH PACKAGE CONTAINING TRIPLE SEALED ICING CUP AND METHOD OF PRODUCING THE SAME

This application is a division of application Ser. No. 345,927 filed Mar. 29, 1973, now U.S. Pat. No. 3,851,757.

FIELD OF THE INVENTION

The present invention relates to dough cans and more particularly to the packaging of fresh dough and another food product in a single container.

DESCRIPTION OF THE PRIOR ART

U.S. Pat. No. 3,182,890 describes a dough container with a plastic icing cup at one end. The open end of the icing cup faces the end of the container. The closed end of the icing cup is provided with a circular gasket which flares outwardly at an obtuse angle to provide a thin feather edge. The package is made by placing the topping or icing in this small open-ended plastic cup which after being filled is inserted open end first, through one end of the cylindrical can body and pushed through the body until it rests against the closed end of the can. The dough is then inserted and the container is sealed. The Zoeller et al U.S. Pat. No. 2,949,369 describes in FIG. 6 another arrangement for packaging the same type of products with which the present invention is concerned. In this package a can or receptacle 30 is filled first and later is placed in a compartment at the bottom of the container with its open end facing upwardly or toward the center of the fiber can. The receptacle 30 is somewhat smaller in diameter than the container 11 and when inserted will fall freely to the bottom of the fiber can.

It can be seen that the Zoeller patent specifically provides that the circular divider wall or plate be from about 0.002 to 0.005 inches larger than the inside diameter of the cylindrical can side wall. In spite of this provision, experience with the Zoeller container for over 10 or more years shows that the dough which is under a pressure of 10–50 p.s.i. nevertheless occasionally extrudes past the edges of the divider wall. While the reason for this extrusion is not known with certainty, it is believed that the elasticity of the fibrous can sidewall under certain conditions permits the can wall to stretch beyond its normal size.

The accumulation of extruded dough which often becomes moldy makes the icing cup unsightly when it is removed and has in the past caused numerous consumer complaints. While the development of mold in the extruded dough does not produce a toxicity hazard, it is unsightly and produces a bad smell.

It was found, for example, where a record of complaints on product lines using a container of the kind described in the Zoeller patent was kept that 40–50% of all consumer complaints were due to extrusion of the dough past the sealing plate. Of these complaints, about ⅓ to ½ concerned mold growth on the dough product in the space around the icing cup.

A thin feather edge of the kind described in U.S. Pat. No. 3,182,890 does not itself provide a reliable seal that will effectively prevent extrusion apparently because of the cold flow characteristics of all thermoplastic resins. The cold flow will be most accentuated where the plastic is thinned down, namely, at the feather edge thereby making the design more subject to failure. Even if there is no cold flow of the plastic, the dough will for some reason become dark along the edge in contact with the plastic seal and form a tough skin that has poor eating qualities. An additional problem is the malformation of the piece of dough in contact with the separator plate where it squeezes into the space at the edge of the plate.

Moreover, since the feathered edge of the Elam patent cup is formed from a plastic material, adjacent parts of the cup itself must be formed from the same resin and it has been found that to resist the pressure of the dough over long periods of time without creeping a substantial thickness of resin is required which of course adds to the cost of the cup.

OBJECTS OF THE INVENTION

The primary objects are: a) the provision of an effective means of preventing the extrusion of dough in a pressurized and sealed fiber dough container from the compartment containing the dough into the space in or around the icing cup compartment of the package without significantly increasing the cost of the package or icing cup, b) the provision of an icing cup arrangement which enables the cup to be filled with icing on the same line as the dough filling line and in sequence therewith while at the same time consistently preventing the extrusion of dough from the dough containing compartment, c) the provision of a simple filling process for a two compartment dough can with a means for making an effective seal between the compartments to prevent dough extrusion and wherein the entire contents of the can, the icing and dough, are inserted from the same end of the can in a single filling line, d) provision for a triple seal between the icing storage compartment and the dough storage compartment to effectively prevent the extrusion of dough from the dough compartment.

THE FIGURES

SUMMARY OF THE INVENTION

Figure 1:
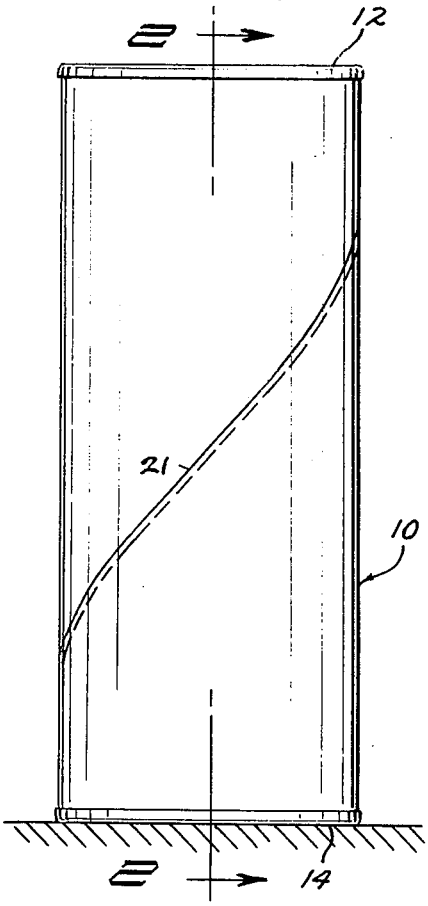
FIG. 1 is a side elevational view of the container embodying the present invention.
Figure 2:
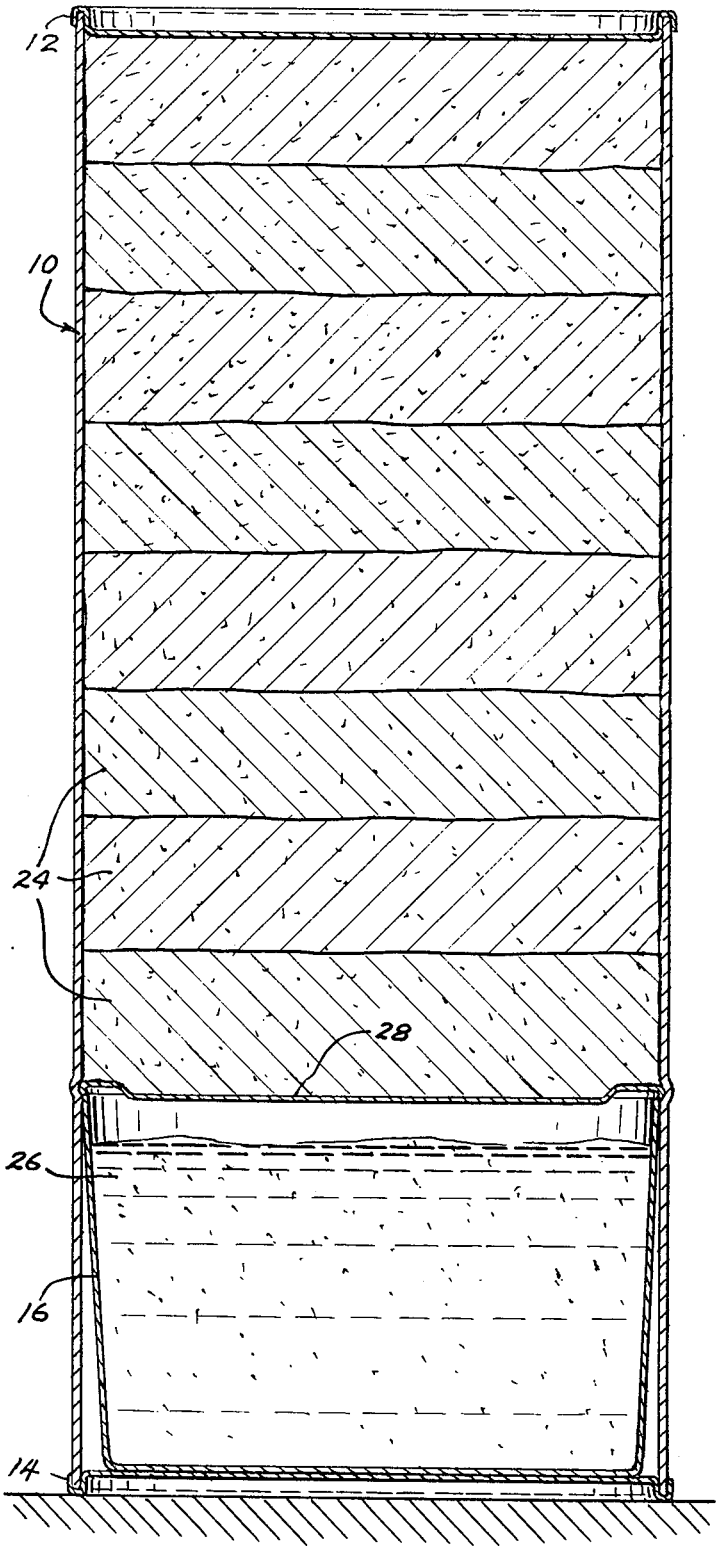
FIG. 2 is a vertical sectional view taken on line 2—2 of FIG. 1 on an enlarged scale.

A two compartment package is disclosed which comprises an outer spirally wound fiber can containing a dough product in one compartment separated from a second compartment by a flat separator member positioned transversely and engaging the inside wall of the container. On the other side of the separator is an icing cup which engages the walls of the container at its open end which faces the separator plate. A triple seal is provided; viz. between the container wall and the separator, between the wall and the cup and between the separator and the cup.

The dough container according to the present invention includes a multiple ply spirally wound tubular peripheral wall usually enclosed by an exteriorly decorative spirally wound removable label. A disk-shaped end closure is secured by crimping or other conventional means to one end of the wall to provide a bottom for the container. After filling the container with a product such as unbaked biscuit dough patties and a non-dough food product such as icing, the container is closed by crimping or otherwise securing a disk-shaped top closure to opposite end of the peripheral wall to define a product package.

The packaging of unbaked dough products and icing or filling presents unique problems which are solved with particular efficiency by the present invention. The biscuit dough patties usually contain baking powder or a similar delayed action leavening agent. In order to facilitate depositing of the patties in the containers, the patties are usually cut so as to have a slightly smaller diameter than the container internal diameter. After the patties are in the cans, generation of leavening gas by the leavening agent causes the patties to rise or "proof". The containers are deliberately not air tight and the expanding dough expells the air from the container, totally filling the container and developing pressure when the surfaces of the dough pieces contact the inner surface of the container at which time the dough itself appears to seal the minute openings in the container thereby preventing leavening gas from escaping from the containers. The pressure of the dough, however, has in the past caused dough extrusion in some cases beyond the separator plate into the icing compartment and it is the triple seal which prevents this.

The package is prepared by partially inserting the icing cup so that its upper end is even with the top of the can. The icing cup is then pressed to the bottom of the can. The end is then placed on that end of the can. The cup is then filled and the separator plate and dough are inserted and the can is sealed.

DESCRIPTION OF THE PREFERRED EMBODIMENT

As shown in the figures, the two compartment package consists of an outer spirally wound fiber body wall which is indicated by the numeral 10 and end walls 12 and 14 which consist of sheet metal closure disks crimped or seamed to the ends of the cylindrical body wall. One end of the fiber container defines the compartment for dough products 24 and the other end holds an icing storage container or cup 16. A metal separator disk 28 divides the two compartments. The icing cup 16 frictionally engages the inner wall 18 of the container at its open end and the open end of the cup faces the separator plate 28. In a typical application of the invention, the outer tubular container wall has a fiber body wall formed by winding a strip of fiberous sheet material into helical configuration applying a label strip and thereafter cutting the tube periodically along its length to form short pieces of tubing. When the fiber container or can is completed, both of the top and bottom closures 12 and 14 respectively are secured thereto to complete the container. The compartments defined by the icing cup 16 and the area above the separator 28 contain food products that are to be isolated from one another. The cup 16 typically contains icing 26 but may contain any of a variety of food products such as fillings, sauces, caramel topping in solid form and the like. If a ready-to-spread icing is provided, it will typically consist of about 65% by weight of sugar 10X, 12% emulsified hydrogenated vegetable oil, 12% water, 10% by weight corn syrup, and 1% flavoring, salt and preservative.

Figure 3:
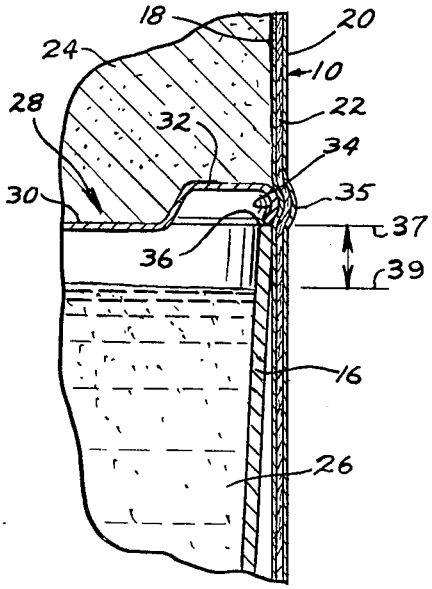
FIG. 3 is a partial vertical sectional view of the container of FIG. 2 showing the seal area between the dough compartment and the icing compartment on a magnified scale.

The detail of the construction of the body wall 10 can be seen by reference to FIG. 3. It will be seen that the body wall 10 consists of an inner fiber layer 22 which can, for example, comprise fiberboard having a thickness of about 0.026 inches, and an inner liner composed of paper and aluminum foil laminate which resists the penetration of oil and moisture vapor. It is also provided with a varnished inner surface. An outer label or cover stock 20 consists of an aluminum foil and paper laminate overlapped slightly as shown in FIG. 1 to provide a smooth outer printing surface.

Between the compartment where the dough 24 is stored in the icing up 16 is provided the triple seal which is best seen in FIG. 3. The triple seal consists of a first seal between the downwardly curled edge 34 of the separator plate 28 and the adjacent portion of the inner surface of the container body wall which because of the tight fit between the separator plate and the body wall, is deflected outwardly somewhat as shown diagramatically at 35 in FIG. 3. The second seal is between the separator plate 28 and the upper edge of 36 of the icing cup 16. This pressure is initially achieved as will be described below by ram pressure when the disk is inserted and later by the pressure of the dough 24 which is normally between 10 and 50 PSIG. If the dough pressure is 15 p.s.i., the pressure of contact between the separator and the cup could be expected to be 250 p.s.i. or above on the line of contact. The third seal extends circumferentially between the upper edge of the icing cup 36 and the inner wall of the adjacent portion of the cylindrical can body wall in the area designated by the arrow between lines 37 and 39.

While the sheet metal separator plate can have a variety of shapes it is normally provided with a circular, downwardly displaced center section 30 and a slightly elevated ring shaped channel 32 (FIG. 3). The periphery 34 is curled downwardly to keep the extreme peripheral edge (the cut edge) of the separator out of contact with the inner can wall during insertion and to provide a means of accurately controlling separator outside diameter.

Thus, it can be seen that there is interference fit between both the separator plate and the body wall 10 as well as between the upper edge of the icing cup 16 and the inner body wall. By the term "interference fit" is meant a positive difference between the dimensions of two mating parts. While the degree of interference fit can be varied depending upon the size of the can and the type of material, it has been found that for cans between about 2–4 inches in diameter the interference fit should be about 0.2% to 0.55% of the inside can diameter. Thus, for example, if the can inside diameter is about 2.258 inches – 2.260 inches, the cup outside diameter at the upper rim and also the separator plate diameter should be about 2.265 inches – 2.270 inches in diameter thereby providing an interference of about 0.005 inch to 0.012 inch in the case of a can of that size.

In the types of containers with which experiments have been conducted, it has been found that when the difference in the interference fit exceeds about 0.55% a bulge can be seen in the outer wall of the container and a certain amount of tearing occurs in the spiral joint of the outer body wall of the container at times. Moreover, it is undesirable to have the outside diameter of the can side wall greater than the outside diameter of the crimped area between the edges of the can covers 12 and 14. Similarly, the can side walls can be damaged by the insertion of the separator plate 28 if the separator plate is too large.

It will be seen that after the can has been completed, the dough 24 which is normally under pressure and will expand the fiber container itself, but because the upward edge of the plastic icing cup 16 is under compression, a certain amount of expansion of the side wall of the container can be tolerated since the cup 16 is able to expand correspondingly.

It can also be seen that the present invention provides the resistence to the extrusion of dough in addition to low cost since no new materials are required. The cup faces upwardly or toward the center of the container to permit the icing cup to be filled on the same assembly line as used to insert dough into the container. Additionally, the metal separator plate provides the strength to resist the expansion of the dough under pressure and also provides resistance to deformation which plastic resins alone cannot provide.

The present invention effectively prevents the extrusion of dough into the space between the icing cup and the can wall 50 and this in turn virtually eliminates the possibility of mold and damage to the appearance to the bottom biscuit.

It will be noticed that the cup 16 is tapered. The purpose for the taper is to facilitate the aid in the release of the cups from molds. A taper of about 1.5% with respect to the axis of the cup is satisfactory for this purpose.

The cup can be made of a variety of thermoplastic resinous materials including the polyolifins, polyethylene, polypropylene, high impact polystyrene and others of the well known thermoplastic resinous materials compatible with food products.

Figures 4, 5, 6, 7:
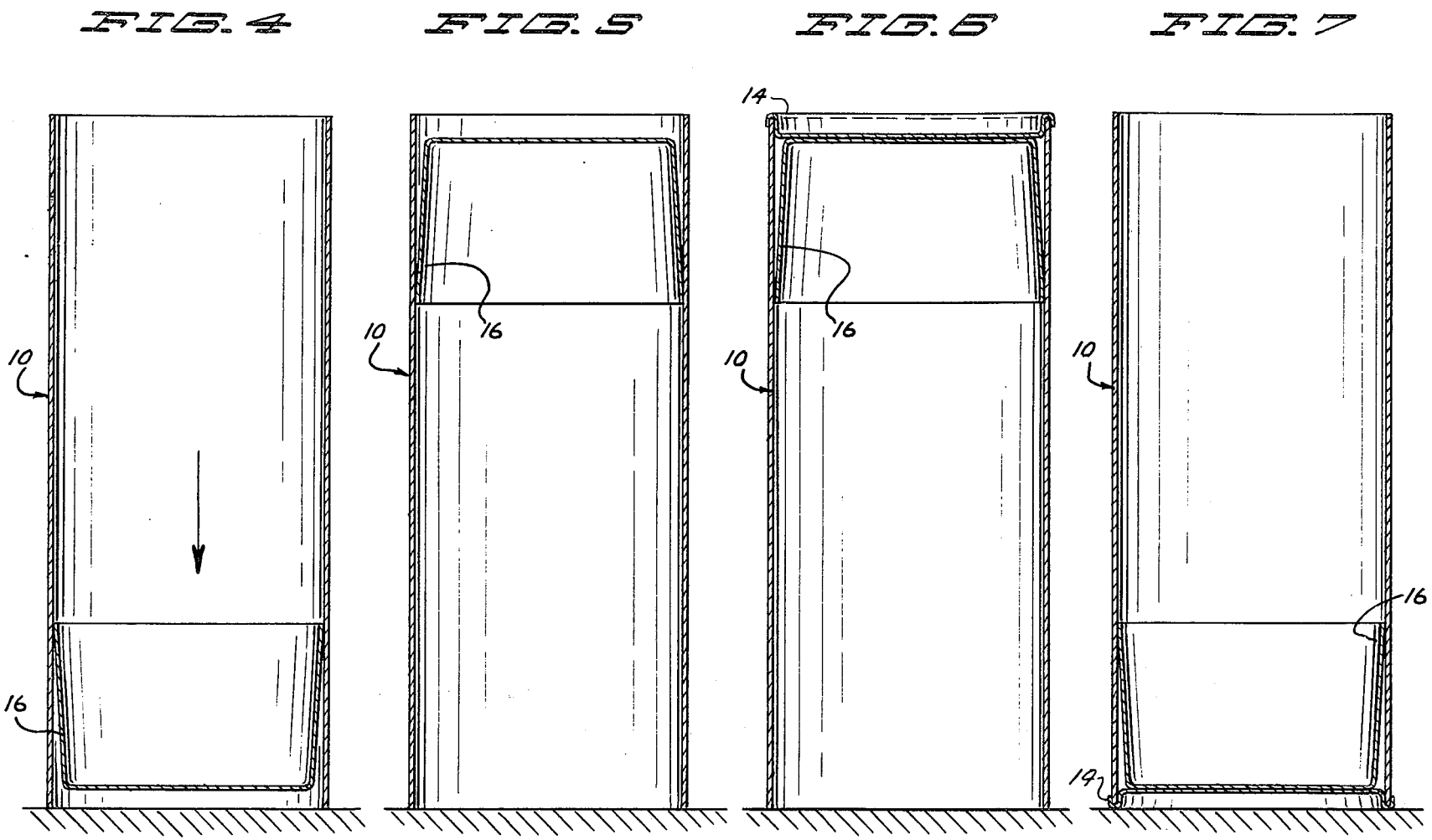
FIG. 4 is a diagrammatic sectional view showing the first stage of inserting the icing cup into a fiber container in accordance with the invention.
FIG. 5 is similar to FIG. 4 showing the next step in fabrication.
FIG. 6 shows the next step of the operation.
FIG. 7 shows the next step: returning the container to its upright position.

The manufacture of the containers will now be described with reference to FIGS. 4–11. As seen in FIG. 4, the icing cup 16 is inserted by forcing it downwardly through the fiber cylindrical container 10 which is at this point open at both ends. This can be done with any suitable reciprocating ram or the like (not shown) or by means of vacuum. The cup is driven toward the botton end of the tube until it is spaced a short distance from the end as shown in FIG. 4. It is important that the cup be seated in bottom of can tube before end is applied, otherwise trapped air prevents the cup from seating. The tube with the cup 16 in place is then inverted and the metal end 14 applied and seamed in place as shown in FIG. 6. As shown in FIG. 7, the container is then returned to its upright position.

Figures 8, 9, 10, 11:
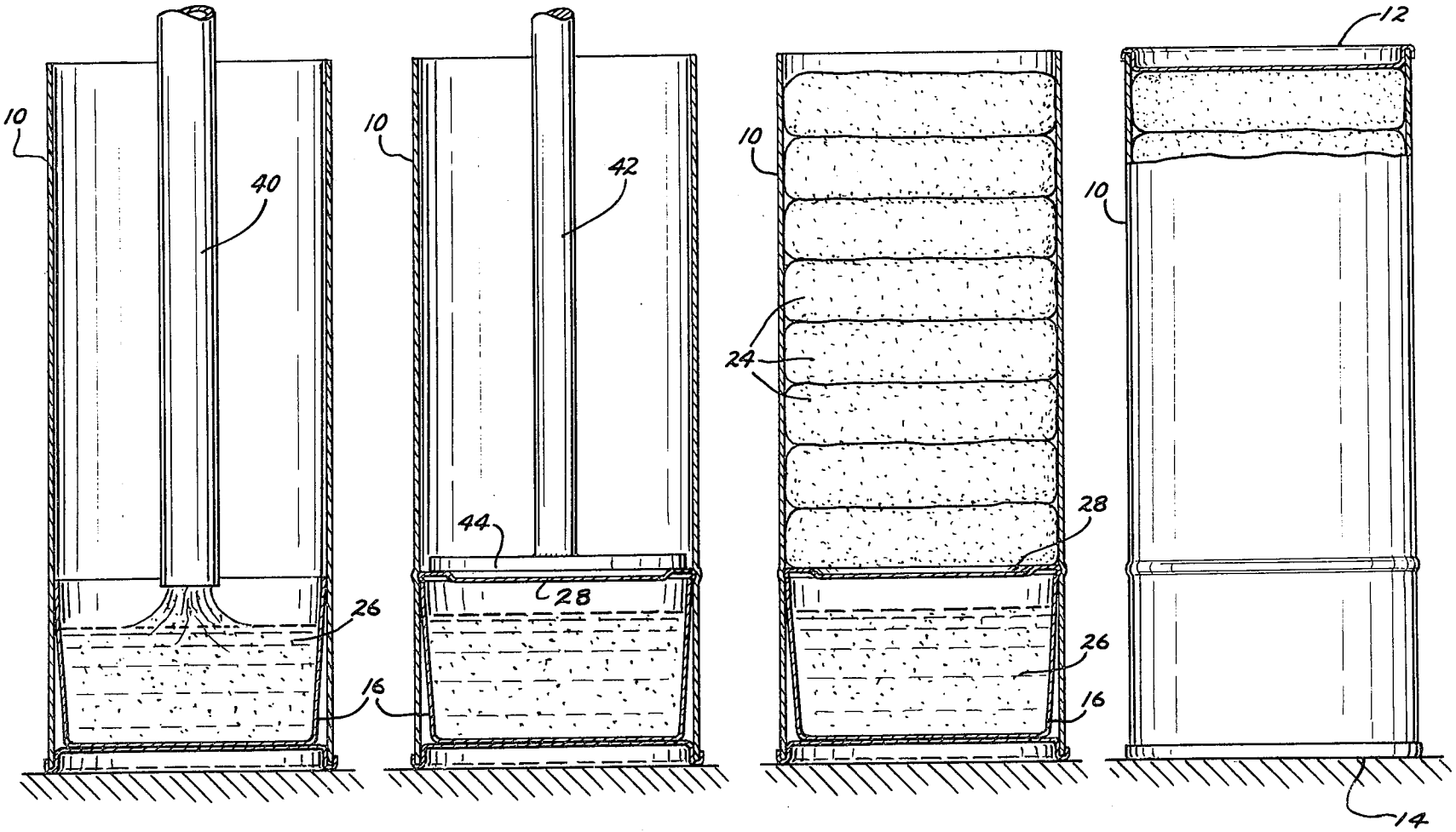
FIG. 8 shows the succeeding step: the insertion of icing.
FIG. 9 shows the introduction of the separator plate.
FIG. 10 shows the insertion of dough.
FIG. 11 shows the application of the end closure to the top of the container.

Next, the icing or other material to be placed in the cup is inserted, for example, through a tube 40 and allowed to flow into the cup as shown at 26 in FIG. 8. When the cup has been filled, the separator plate 28 is driven downwardly into the desired position sealing the upper end of the cup and the adjacent surface of the inner wall of the tube 10. This operation is accomplished by means of a ram 42 consisting of a shaft with a circular head 44 the lower surface of which is shaped to fit the recess 30 and the separator plate 28. The pressure of the ram 42 forces the separator plate 28 against the upper edge of the cup 16 thereby establishing the initial contact between the plate and the cup. The dough 24, after being placed in the can and proofed exerts further pressure continuously thereby maintaining the seal between the separator plate and the cup initially established by the ram.

What is claimed is:

1. A process of forming a two compartmented fiber dough can comprising providing a tubular fiber dough container body, providing a generally cylindrical cup adapted to contain a food product other than dough, the cup being formed from a thermoplastic resinous material compatible with food substances, said cup having an open end and a closed end and the open end having an enlarged diameter adapted to engage the inner surface of the cylindrical fiber body wall with an interference fit, forcing the cup into the tubular container body coaxially thereof closed end first until it has reached substantially the opposite end of the container body from which it was inserted whereby the open end of the cup faces toward the center of the container body, lowering duct means into the container body after the cup has been placed in the container, inserting a food product comprising icing into the cup through said duct means providing a circular divider wall of rigid sheet material having a circular peripheral edge adapted to engage in sealing relationship with the inner wall of the container body, the peripheral edge of the divider wall being of a larger diameter than the inside diameter of the container body to thereby provide an interference fit therebetween, forcing the divider wall into the tubular container body until the peripheral edge engages the upper open end of the cup and rests thereon to provide a circular seal therebetween, whereby there is formed a triple seal comprising the interference fit between the divider wall and the inside wall of the container the interference fit between the divider wall and the open end of the cup and interference fit between the cup and the inner wall of the fiber can body, introducing a leavened dough product into the compartment on the opposite side of the divider wall from the cup and sealing the open end of the tubular container body by applying a top closure to the end of the body through which the dough product was inserted and allowing the dough to proof to develop a pressure between about 10 and 60 p.s.i. and the dough pressure exerts a downward force on the divider following proofing to maintain the seal between the divider and the cup.

* * * * *